United States Patent [19]

Osborn

[11] Patent Number: 4,982,637

[45] **Date of Patent: * Jan. 8, 1991**

[54] ROTARY CUTTING APPARATUS

[75] Inventor: Paul V. Osborn, Webster, N.Y.

[73] Assignee: Mobil Oil Corporation, Fairfax, Va.

[ * ] Notice: The portion of the term of this patent subsequent to Apr. 10, 2007 has been disclaimed.

[21] Appl. No.: 419,876

[22] Filed: Oct. 11, 1989

Related U.S. Application Data

[60] Continuation-in-part of Ser. No. 248,283, Sep. 22, 1988, Pat. No. 4,914,995, and Ser. No. 245,595, Sep. 16, 1988, Pat. No. 4,923,013, which is a division of Ser. No. 38,079, Apr. 14, 1987, abandoned, said Ser. No. 248,283, is a continuation of Ser. No. 38,079, Apr. 14, 1987, abandoned.

[51] Int. Cl.[5] ..... B26D 1/62

[52] U.S. Cl. ..... 83/346; 83/348; 83/659; 83/701

[58] Field of Search ..... 83/346, 348, 659, 343, 83/701

[56] References Cited

U.S. PATENT DOCUMENTS

| | | | |
|---|---|---|---|
| 1,618,191 | 2/1927 | Hemberger . | |
| 2,445,831 | 7/1948 | Hoffman et al. . | |
| 2,768,692 | 10/1956 | Engel | 83/348 X |
| 2,897,729 | 8/1959 | Ashton et al. . | |
| 3,031,905 | 5/1962 | Phillips et al. | 83/86 |
| 3,147,656 | 9/1964 | Kwitek | 83/116 |
| 3,257,385 | 6/1966 | Hornung | 83/348 X |
| 3,414,032 | 12/1968 | Jortikka | 150/1.7 |
| 3,800,640 | 4/1974 | Barrie | 83/37 |
| 4,400,117 | 8/1983 | Smith | 407/49 |
| 4,624,654 | 11/1986 | Boyd et al. | 493/194 |
| 4,656,900 | 4/1987 | Herrington | 83/24 |
| 4,671,152 | 6/1987 | Blumle | 83/152 |
| 4,802,394 | 2/1989 | Gamberini et al. | 83/346 |
| 4,914,995 | 4/1990 | Osborn | 83/100 |

FOREIGN PATENT DOCUMENTS

| | | |
|---|---|---|
| 2054474 | 9/1971 | Fed. Rep. of Germany . |
| 2722872 | 11/1978 | Fed. Rep. of Germany . |
| 3302038 | 7/1984 | Fed. Rep. of Germany . |

*Primary Examiner*—Hien H. Phan
*Assistant Examiner*—Eugenia A. Jones
*Attorney, Agent, or Firm*—Alexander J. McKillop; Charles J. Speciale

[57] ABSTRACT

Apparatus particularly suited for cutting continuously moving thermoplastic film such as linear low density polyethylene and includes a stationary anvil, preferably a roller of tool steel and a tungsten carbide die mounted for rotation along a circular arc intersecting the anvil. The roller is positioned at a stationary location along a circular arc for cyclicly contacting and rolling across the cutting surface for cutting the plastic film web passing between the roller and the cutting surface at the predetermined locations in the web. The roller is mounted on a support member by an assembly including a bracket mounting a shaft supporting the roller. The bracket is attached to one end of a rocker arm and the other end of the rocker arm is pivotally carried by the support member. A housing for a loading spring is carried by the support member adjacent the rocker arm. The housing has a tubular opening therethrough having an axial extending transversely to the axis of the shaft supporting the roller. A helical loading spring is disposed within the tubular opening of the housing and has one end engaging the rocker arm. A spring adjusting screw is carried in one end of the tubular opening in the housing for engaging the opposite end of the helical spring to adjust the load pressure of the spring applied to the roller. A stop member is carried by the support member on the opposite side of the rocker arm to limit movement of the roller in the direction of the cutting surface.

9 Claims, 9 Drawing Sheets

ROTARY CUTTING APPARATUS

This is a continuation-in-part of application Ser. No. 248,283 filed Sept. 22, 1988, now U.S. Pat. No. 4,914,995, which in turn is a continuation of parent application Ser. No. 038,079 filed Apr. 14, 1987, now abandoned. The present application is also a continuation-in-part of application Ser. No. 245,595 filed Sept. 16, 1988, now U.S. Pat. No. 4,913,013, which is a division of the aforesaid parent application Ser. No. 038,079 filed Apr. 14, 1987.

BACKGROUND OF THE INVENTION

This invention relates to rotary cutting apparatus and, in particular, an apparatus suitable for high speed cutting of plastic film webs, such as linear low-density polyethylene ("LLDPE") film which is difficult to cut.

It is quite common in manufacturing processes, such as plastic bag manufacture, to punch holes in or otherwise perforate a plastic film web, particularly while the web is moving, to manufacture plastic bags from the web. Manufacturing productivity is generally increased the faster the plastic web can be moved through the manufacturing line. However, increased speed may affect the quality of the cuts being made in the web. In the case of mechanically contacting cutters, wear and downtime for replacing or refinishing of the cutting surfaces also may be significant. A number of devices suitable for automatic mechanical cutting of a moving plastic film are known and have been considered.

A reciprocating punch can be employed to make cuts at the edge of a continuously moving plastic film web. This method has previously been employed in punching semi-circular cutouts in the hem edge of a continuous moving plastic web during the manufacture of draw tape strip bags. See, for example, U.S. application Ser. No. 652,254, filed Sept. 20, 1984, now U.S. Pat. No. 4,624,654 assigned to the assignee of the present invention and incorporated by reference herein.

Air cylinder actuated reciprocating punches were used on the draw tape bag manufacturing line disclosed in the aforesaid U.S. application Ser. No. 652,254. Initially, a hemispherical punch reciprocating against a smooth circular die was employed. However, the LLDPE material was so stretchable, that the slightest gap between the punch and die would stretch rather than cut the material. The larger the hole desired, the more likely that incomplete cutting would occur.

A serrated edge circular die was substituted which does not require a close fit with the punch thus avoiding metal contact. The serrated edge die was found adequate for existing cycling speeds (approximately 100 cycles per minute for 24 inch wide bags). At higher speeds, punching the plastic web on the fly produced tension variations within the web which were sufficiently great as to disrupt other web processing operations. Moreover, cutting at higher speeds leaves a more jagged edge. It would be extremely desirable to provide a punch for punching holes in a continuously moving LLDPE plastic film web at cycling rates of at least 120 cycles per minute and web speed in excess of 240 feet per minute.

A commercially available, solenoid powered reciprocating punch having a conical punch head penetrating a circular die was also examined. The punch was found to have a life of about one million cycles through four thicknesses of approximately 1.5 mils LLDPE film.

However the punch was noisy and was found to stick or "block" the edges of the layers together making subsequent insertion of a draw tape strip between the layers difficult.

Also examined was a commercially available rotary punch and die formed by a pair of complimentary contacting cutting surfaces in a pair of adjoining rolls. Several thousand pounds of compression on the rolls was required to obtain a cut and quickly dulled the cutting surfaces. The system was found to have a life of only about 5,000 holes or cycles.

SUMMARY OF THE INVENTION

It is an object of the invention to provide a plastic film cutting apparatus capable of a high cycling rate and variable speed operation.

It is yet another object of the invention to provide a plastic film cutting apparatus which provides clean, undistorted cuts in the film at predetermined locations even at relatively high cycling rates and film speeds.

It is yet another object of the invention to provide a plastic film cutting apparatus which is relatively quiet in operation.

These objects and others are accomplished according to the present invention by providing a cutting die having a cutting surface mounted on a rotary support for rotating the cutting surface along a circular arc and positioning a roller adjacent the rotary support at a stationary location along the circular arc so as to cyclically contact and roll across the cutting surface of the die when the die is rotated on the rotary support past the roller whereby the cutting surface and the roller cooperate for cutting a plastic film web passing therebetween at predetermined locations in the web.

According to another important aspect of the invention, the roller is resiliently biased in a controlled manner toward the contacted cutting surface so as to generate minimum, substantially uniform compressive force against the cutting surface for a smooth, uniform cut.

It is yet another object of the invention to provide an apparatus for mechanically cutting plastic film and the like having long life.

It is yet another object of the invention to provide a mechanical cutting device providing superior performance on LLDPE film.

According to the invention, this and other objects are accomplished by forming the cutting surface of the die from tungsten carbide and the roller from tool steel.

It is yet another object of the invention to provide an improved apparatus for cutting holes in moving plastic film webs.

According to this object of the invention, a cutting die having a closed curve cutting surface, conforming to the outline of the cut desired, is employed. The cutting die is hollow within the closed curve cutting surface and is coupled with a hollow interior of the rotary support. A vacuum blower coupled with the hollow interior of the rotary support creates a vacuum at the die cutting surface for removing a plug of cut material. A hollow roller may be conveniently employed as the rotary support for the closed cutting surface die.

It is yet another object of the invention to provide a rotary cutting apparatus for making parallel perforation cuts along a continuously moving web.

According to this object of the invention, a cutting die having a straight tungsten carbide cutting edge is mounted on a rotary support for rotating the cutting edge along an arc so as to contact during each rotation a stationarily positioned tool steel roller.

In accordance with a further object of the invention there is provided an improvement in apparatus for cutting a moving plastic film web at predetermined locations having a die with a cutting surface and means supporting the die for rotating the cutting surface along a circular arc. The improvement comprises roller means positioned at a stationary location along the circular arc for cyclicly contacting and rolling across the cutting surface for cutting the plastic film web passing between the roller means and the cutting surface at predetermined locations in the web. The roller means comprises a roller mounted on a support member by an assembly including a bracket mounting a shaft supporting the roller. The bracket is attached to one end of a rocker arm and the other end of the rocker arm is pivotably carried by the support member. A housing is provided for a loading spring carried by the support member adjacent the rocker arm, the housing having a tubular opening therethrough having an axis extending transversely to the axis of the shaft supporting the roller. A helical loading spring is disposed within the tubular opening of the housing and having one end engaging the rocker arm. Spring adjusting screw means is threadedly carried in one end of the tubular opening in the housing for engaging the opposite end of the helical spring to adjust the load pressure of the spring applied to the roller and stop means is carried by the support member on the opposite side of the rocker arm to limit the movement of the roller in the direction of the cutting surface.

The various objects and advantages of the invention will be better understood by reference to the accompanying drawings and detailed description of the embodiments.

DETAILED DESCRIPTION OF THE INVENTION

Figure 1:
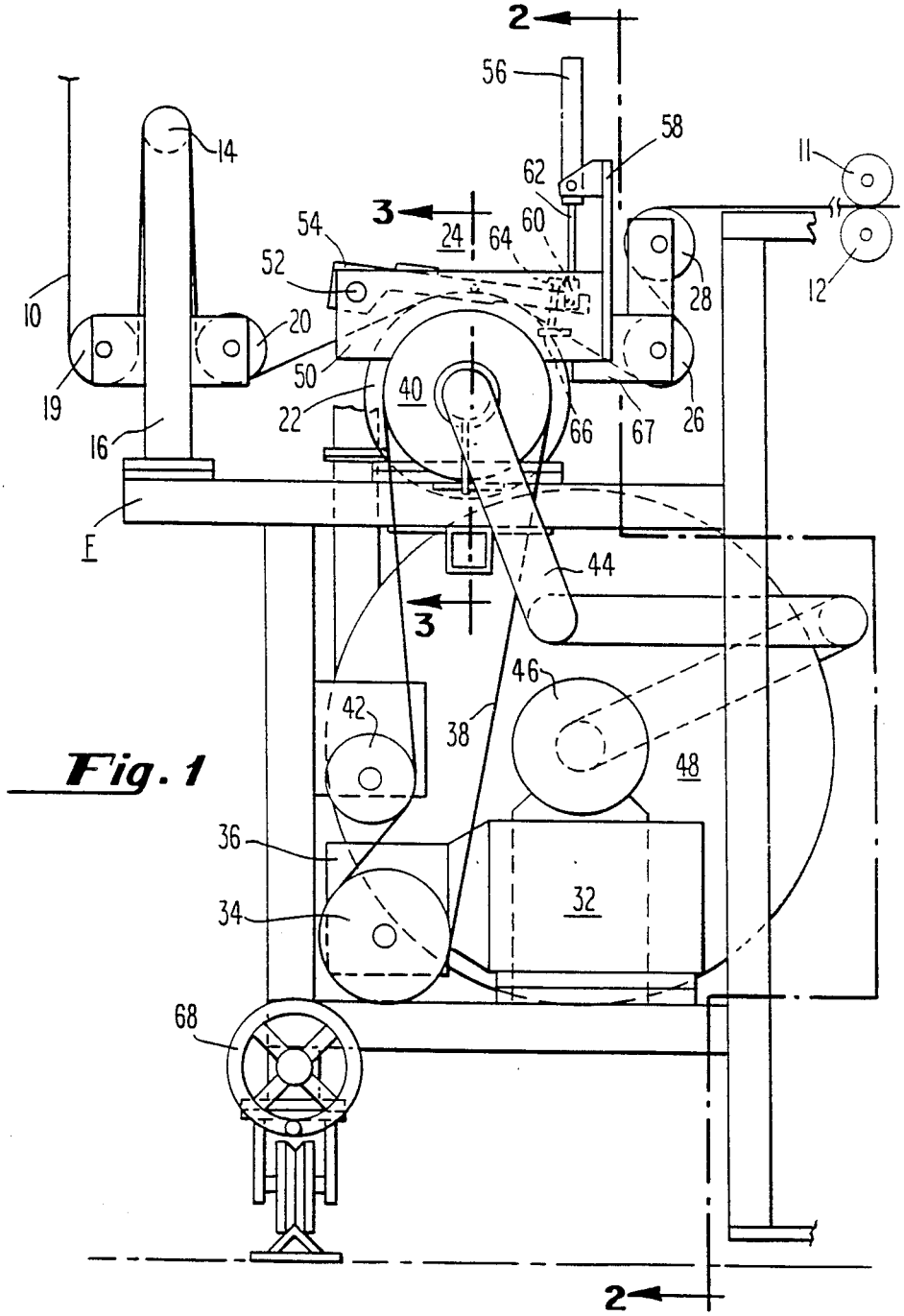
FIG. 1 is a side elevation view of a rotary cutting apparatus of the present invention for cutting a hole in a moving plastic film web.

FIG. 1 illustrates a portion of a thermoplastic draw tape hag manufacturing line of the type disclosed in U.S. application Ser. No. 652,254 referred to above. A thermoplastic film web 10 in the form of a once folded thickness of linear low-density polyethylene (LLDPE) or other plastic Film is drawn from a supply roll (not shown) by draw rolls 11 and 12 over a hem folder 14 mounted on a vertical member 16 of the frame F. Idler rolls 19 and 20, also supported on vertical member 16 below and to either side of the hem folder 14, cause the web 10 to pass over the upper surface of the hem folder 14 where the slit edges of the two film layers are folded over to form hems for receiving draw tapes. From the idler roll 20, the web with the hems formed therein is passed over the roller 22 of the rotary cutter or punch of the present invention, referred to generally by the reference numeral 24. Idler rolls 26 and 28 mounted on the frame F downstream from the rotary cutting apparatus 24 raise the film path for passage of the web 10 through a draw tape strip insertion device and a hot air hem sealer, both normally positioned between the roller 28 and draw rolls 11 and 12. The tape inserter and hem sealer are not a part of the present invention and are omitted from the figures for clarity.

The roll 22 is rotated by means of a motor 32 driving a pulley 34 through a reduction gear assembly 36. A belt 38 couples the pulley 34 with a pulley 40 coaxial with and mounted to an end of the roll 22. A pulley 42 is provided for tensioning the belt 38. A vacuum line 44 extends from the center of the roll 22 and pulley 40 to a blower motor 46 supporting a blower 48 on an opposing side of the machine, FIGS. 1 and 2.

Figure 2:
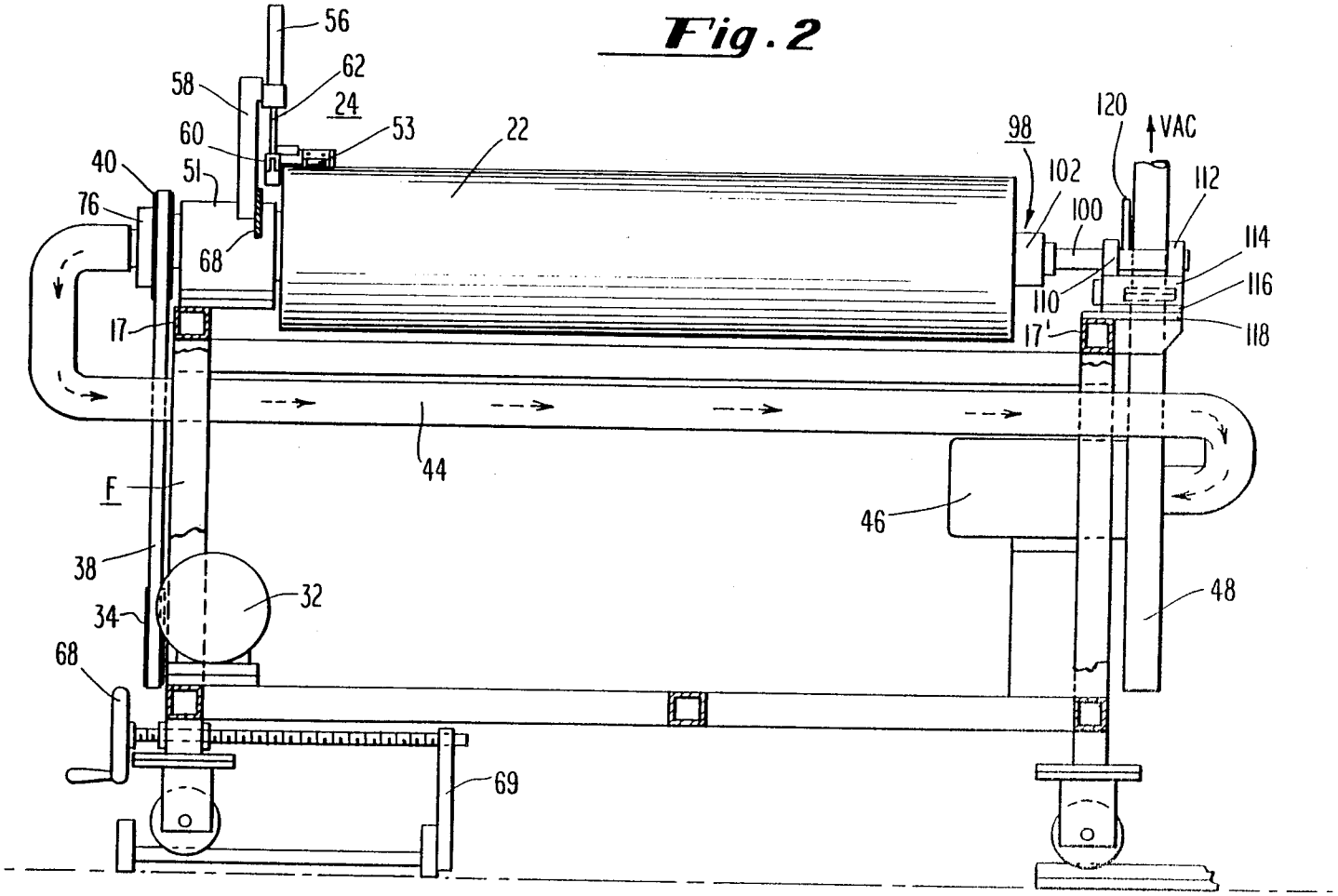
FIG. 2 is an elevation view of the apparatus of FIG. taken along the lines 2—2 in FIG. 1.

The rotary cutting apparatus 24 further includes a stationary support member 50 coupled to the frame F by another stationary support member 51, FIG. 2. The support member 50 in turn supports a pivot shaft 52, FIG. 1, rotatably supporting an arm 54 which carries a roller 53, FIGS. 2 and 3 (omitted from FIG. 1 for clarity) which runs against a cutting die 134 which projects above the surface of roll 22, FIGS. 4 and 5, as hereinafter described. A small ga is maintained between the roller 53 and the surface of roll 22 so that the roller 53 does not ride on the web between cutting operations. Retraction and advancement of the arm 54 is controlled by an air cylinder 56, FIG. 1, supported by a bracket 58 mounted to the support member 50. A clevis 60 at the end of piston rod 62 of the cylinder 56 is rotatably coupled to an end of the arm 54. An adjusting screw 64 passing through a portion of the arm 54 contacts a stop 66 mounted to the support member 50 to set the pressure on a leaf spring member 142, FIG. 3 and limits the downward motion of the arm 54 by the cylinder 56. A plate 67 attached to member 50 supports one side of the idler rolls 26, 28. A transverse hand adjustment screw 68 threaded through a member 69, FIG. 2, stationarily mounted to the floor adjusts the position of the frame F into and out of the plane of FIG. 1 for aligning the frame F with a downstream portion of the bag manufacturing line on a separate frame member.

Figure 3:
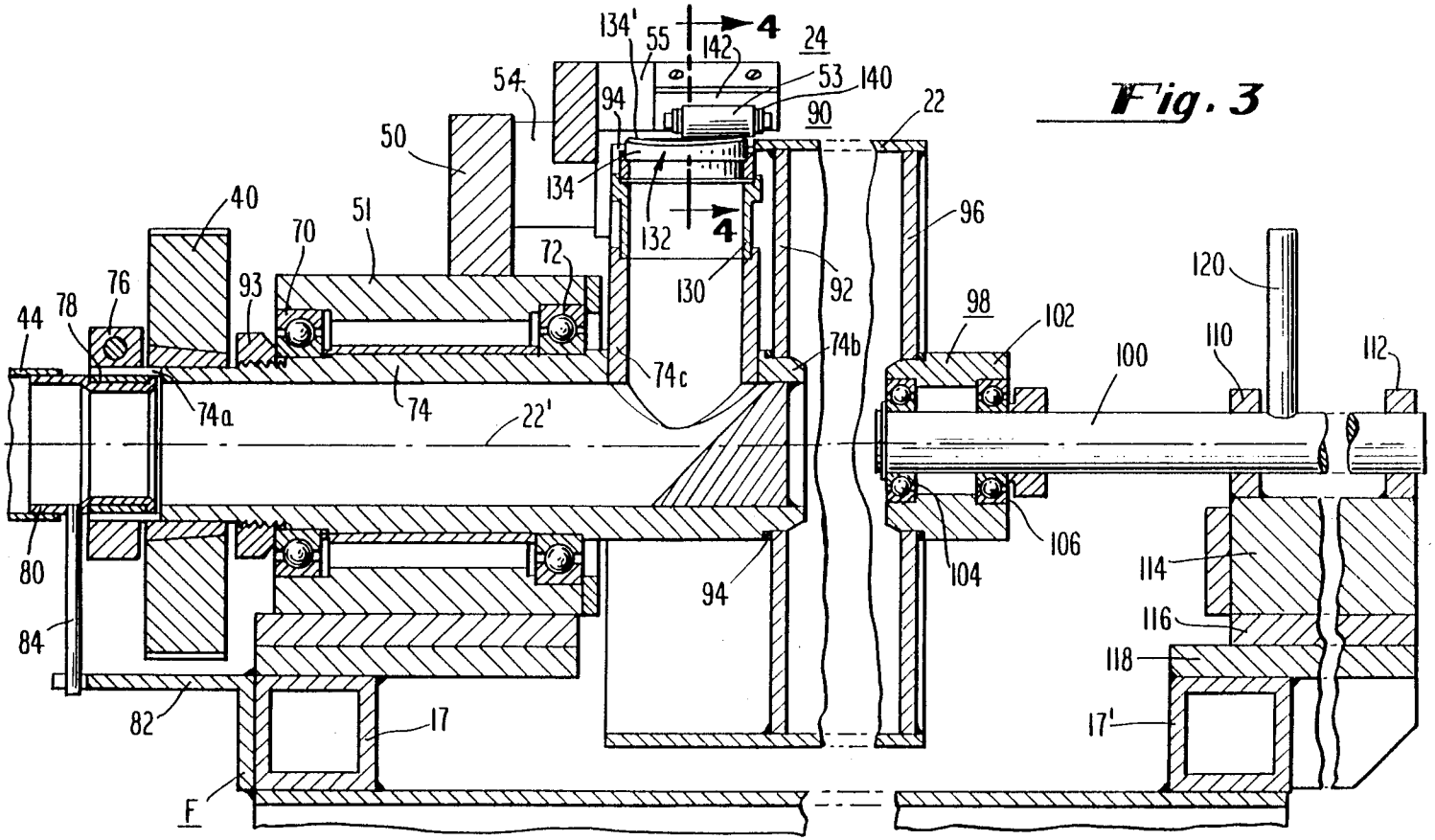
FIG. 3 is a sectional view of a portion of the apparatus of FIG. 1 along the lines 3—3 in FIG. 1.

Referring to FIGS. 2 and 3, mounting block 51 supports the stationary support member 50 on its upper surface and is supported on horizontal frame member 17. The support block 51 includes a pair of journaled bearing 70 and 72, FIG. 3, rotatably supporting a hollow shaft 74 fixed to the left hand end of roll 22 and to support the pulley 40. A collar 76 holds a projecting hollow end portion 74a of the shaft 74 against a split bearing 78 mounted in an end of a hollow adaptor 80 which connects to the vacuum line 44. The adaptor 80 is connected to the horizontal frame member 17 by a bracket 82 and pin 84 to prevent the vacuum line 44 from turning with the roll or drum 22.

The right hand end of the hollow shaft 74 supports for rotation therewith a radially extending die assembly 90 which forms part of the rotary cutting apparatus 24 of the present invention. An annular plate member 92 is mounted within the roll 22 recessed from the left hand edge of roll 22 to permit insertion of the assembly 90 within the roll 22. An inner circular opening of the annular plate 92 receives a plugged end 74b of the hollow shaft 74. An 0-ring 94 is provided between a shoulder on the shaft 74 adjacent the end 74b and plate 92 and is held in place by the annular compression nut 93 threadedly engaging the opposite end of shaft 74. The extreme radial end of die assembly 90 is exposed through an opening 94 at the left hand axial edge of the cylindrical outer surface of the roll 22. Another annular plate 96 is mounted within the roll 22 at the right hand end and receives a cylindrical plug assembly 98 supported on a stub shaft 100 coaxial with the roll 22 and hollow shaft 74. The assembly 98 includes a cylindrical housing 102 having therein a pair of journal bearings 104, 106 rotatably supporting the roll 22 on the shaft 100. The housing 102 is inserted into a central circular opening in the annular plate 96 and is frictionally coupled thereto for rotation therewith about the shaft 100. The shaft 100 is slideably supported in a pair of flange members 110 and 112 coupled through a plurality of frame member 114, 116 and 118 to a horizontal tubular member 17' symmetric with the horizontal tubular frame member 17. A handle 120 connected with the shaft 100 allows the shaft 100 to be moved axially with respect to the cylinder 22 to insert or withdraw the plug assembly 98 from the annular plate member 96. The roll 22 is adapted to be replaced for different widths of bags. For example the same roll 22 may be used for bag repeat lengths of 20" to 24". Another roll may be used for repeat lengths of 30" to 33". This mounting arrangement provides for ease of removal of the roll 22 for change in repeat lengths between bags. The roll 22 may be temporarily supported by any conventional means such as wedges beneath the roll when plug 98 is withdrawn.

Figure 4:
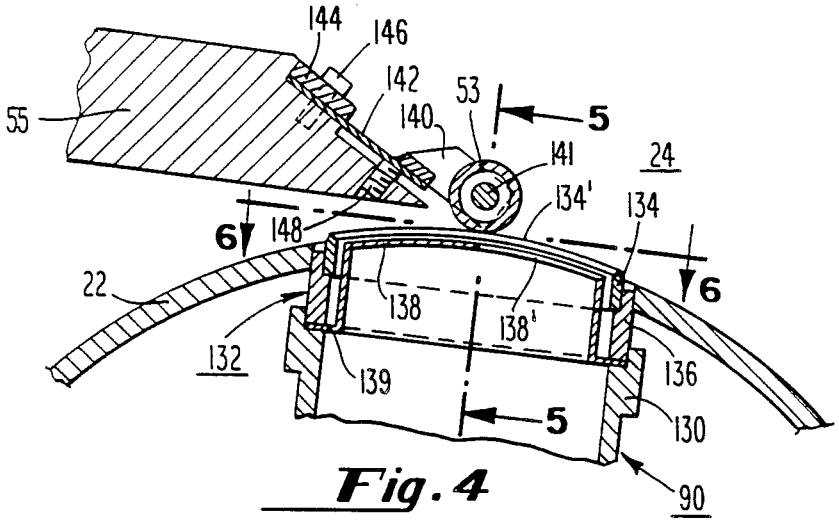
FIG. 4 is an enlarged sectional view of the roller support arm and cooperating rotary supported cutting die of the apparatus of FIG. 1 taken along the lines 4—4 in FIG. 3.
Figure 5:
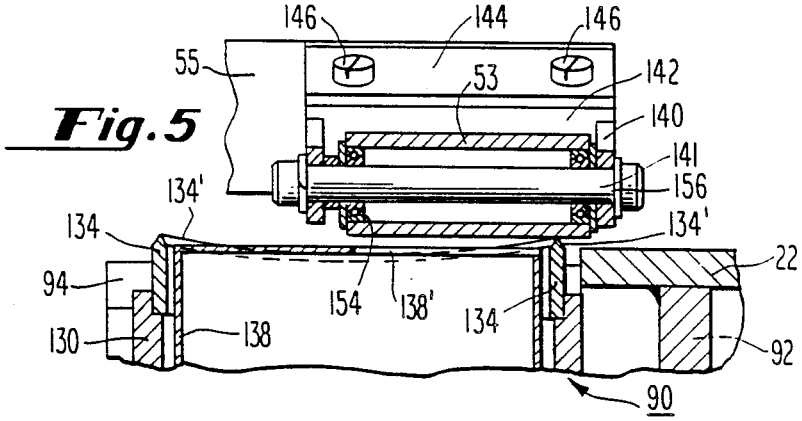
FIG. 5 is a sectional view taken along the lines 5—5 in FIG. 4.
Figure 6:
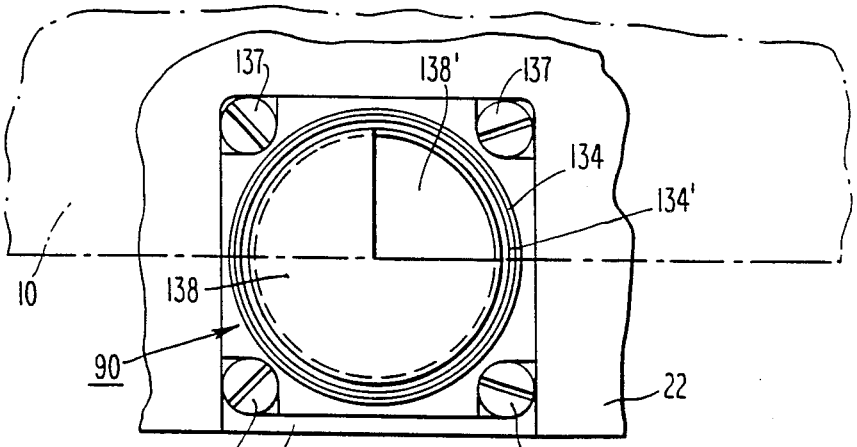
FIG. 6 is a sectional view taken along the lines 6—6 in FIG. 4.

The die assembly 90 is mounted by screws or other suitable means (not shown), to a tubular collar 74c, FIG. 3, extending radially from the hollow shaft 74 and having its hollow interior coupled with the hollow interior of the hollow shaft 74. The assembly 90 includes a hollow, tubular spacer 130 positioned in the end of collar 74c and adapted to receive a die and baffle sub-assembly 132. The spacer 130 is used when a roll size is changed for different bag sizes. The components of sub-assembly 132 are best seen in FIGS. 4–6 and include a tungsten carbide die 134 mounted by suitable means such as a hollow metal holder 136 which is mounted by screws 137, FIG. 6, to the underlying tubular spacer or collar 130. A sheet metal baffle plate 138 is positioned within the die 134 and held in place by means of an external annular flange 139 held between the holder 136 and the collar 130. A quarter circle opening 138' is provided in the baffle plate 138 to apply a vacuum to the leading end of the portion of the plastic film web being cut from the web by the die 134. By applying vacuum to the leading end of the cut out portion, the film is stretched during the cutting thereby preventing wrinkling and a jagged cut.

Referring to FIGS. 3–5, the cutting action of the rotary cutting apparatus 24 is provided by the cutting die 134 in cooperation with the roller 53. The roller 53 is mounted to "L" shaped support member 55 extending from a side of support arm 54, by an assembly which includes a bracket 140 mounting a shaft 141 supporting the roller 53 and attached to one end of a leaf spring member 142, the opposite end of which is mounted by means of a bracket 144 and screws 146 to the "L" shaped member 55. It will be noted in FIG. 4 that the leaf spring member 142 acts as a leaf spring cantilever arm fixed at one end and supporting the roller 53 at the other end. It is desirable to minimize the movement of the roller 53 with respect to the die 134 to cut down on the bounce effect. An adjustment screw 148 extending through a threaded bore in the end of support member 55 contacts the leaf spring member 142 to preload the spring to minimize the inertia forces and adjust the height of the roller 53 with respect to the cutting surface or edge 134' of the die 134. As seen in FIG. 5, the roller 53 is supported on bearings 154 and 156 on shaft 141. The roller 53 is desirably made from a material softer than tungsten carbide, preferably A7 tool steel.

The apparatus as described above is used to cut semicircular openings along the hem edge of the web 10 to form hand holes for draw tape bags. As may be seen in FIG. 6, the hem edge of the web 10 passes over only one-half of the cutting die 134. Accordingly, the roller 53 which cooperates with the cutting die 134 to cut the web 10 spans only one-half the circular die 134, FIGS. 3 and 5.

As best seen in FIG. 6, the die 134 is circular in plan view. However, as best seen in FIGS. 3–5, the contour of the cutting surface or edge 134' is saddle shaped to conform to the cylindrical geometry of the roll 22 and to project slightly and uniformly beyond the surface of the roll 22. Referring to FIG. 3, the radial distance between each point of the cutting edge 134' and the central axis 22' of the roll 22 (i.e. axis of rotation) is uniform. In a specific application of the invention, the height of the spring 142 was adjusted to apply approximately 30 lbs. of force through the roller 53 when used to cut through four thicknesses of 1.4 mil linear low density polyethylene film forming draw tape bags of the type described in the aforesaid related patent application Ser. No. 652,254. At speeds of up to 135 cycles per minute, a rotary cutting apparatus according to the present invention was capable of providing a service life of about 7,000,000 (holes) cycles when a tool steel roller is used in combination with a tungsten carbide die.

When a tool steel planar wiper blade was mounted to the leaf spring member 142 in place of the roller 53 for contacting the cutting surface 134' of tungsten carbide die 134 with an interference between the blade and the die of about 0.003–0.004 inch, service life of this combination was reduced to approximately 500,000 cycles.

Figure 7:
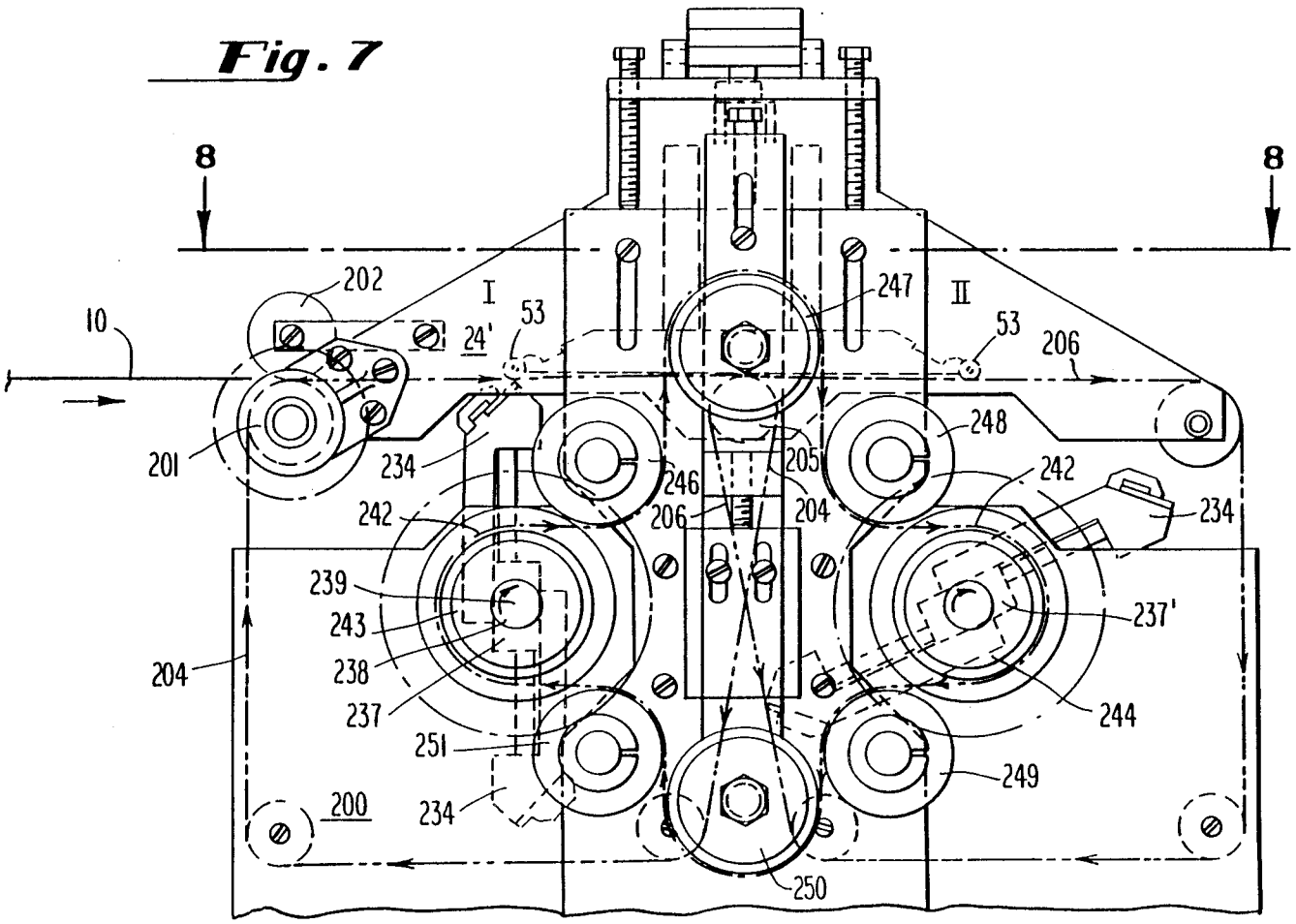
FIG. 7 is a side elevation of another embodiment of the invention incorporated in a plastic film perforator.
Figure 8:
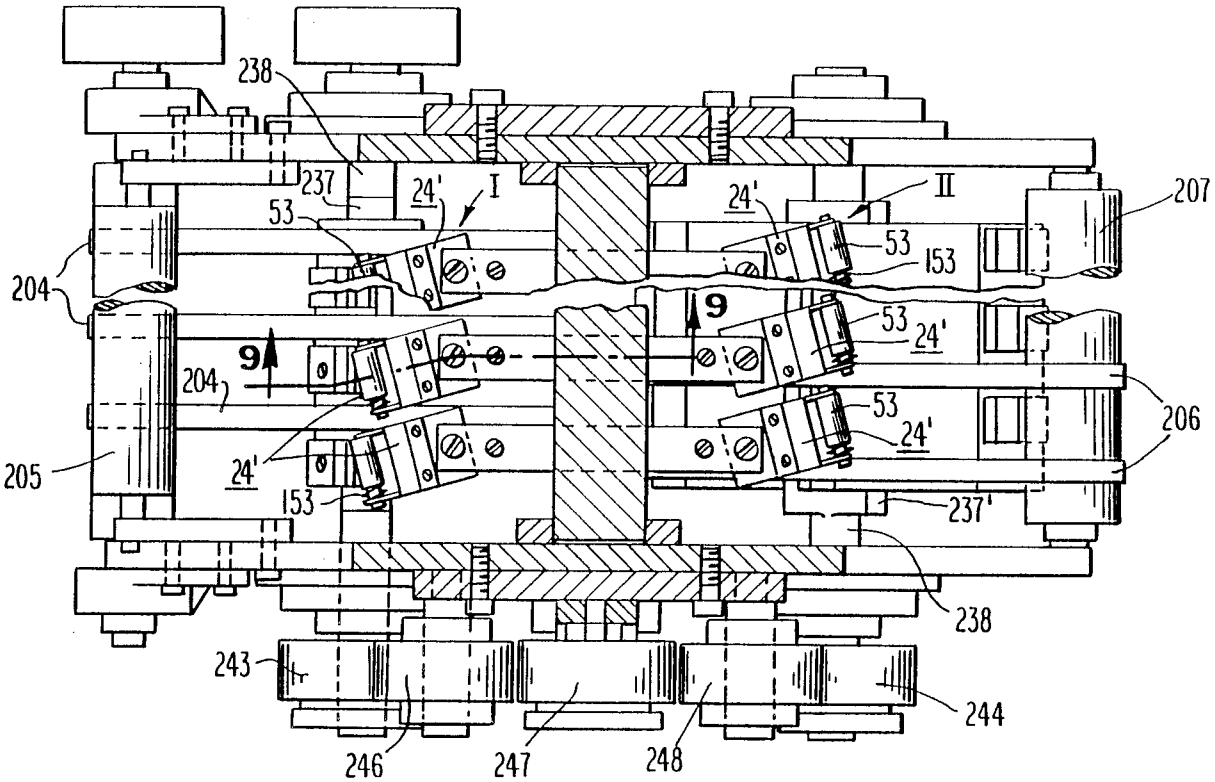
FIG. 8 is a partially sectioned plan view of the apparatus of FIG. 7 taken along the lines 8—8 in FIG. 7.
Figure 9:
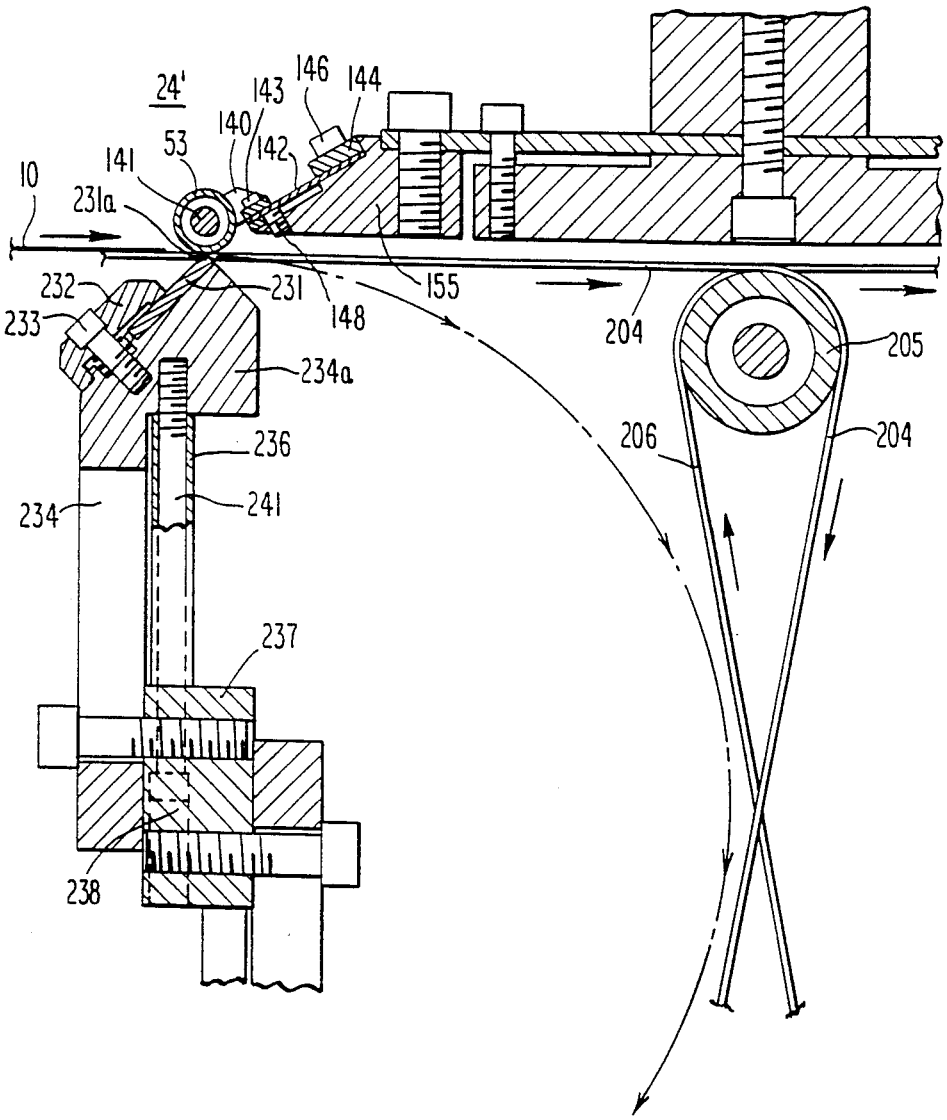
FIG. 9 is a fractional sectional view of the apparatus of FIG. 7 taken along the lines 9—9 of FIG. 8.
Figure 10:
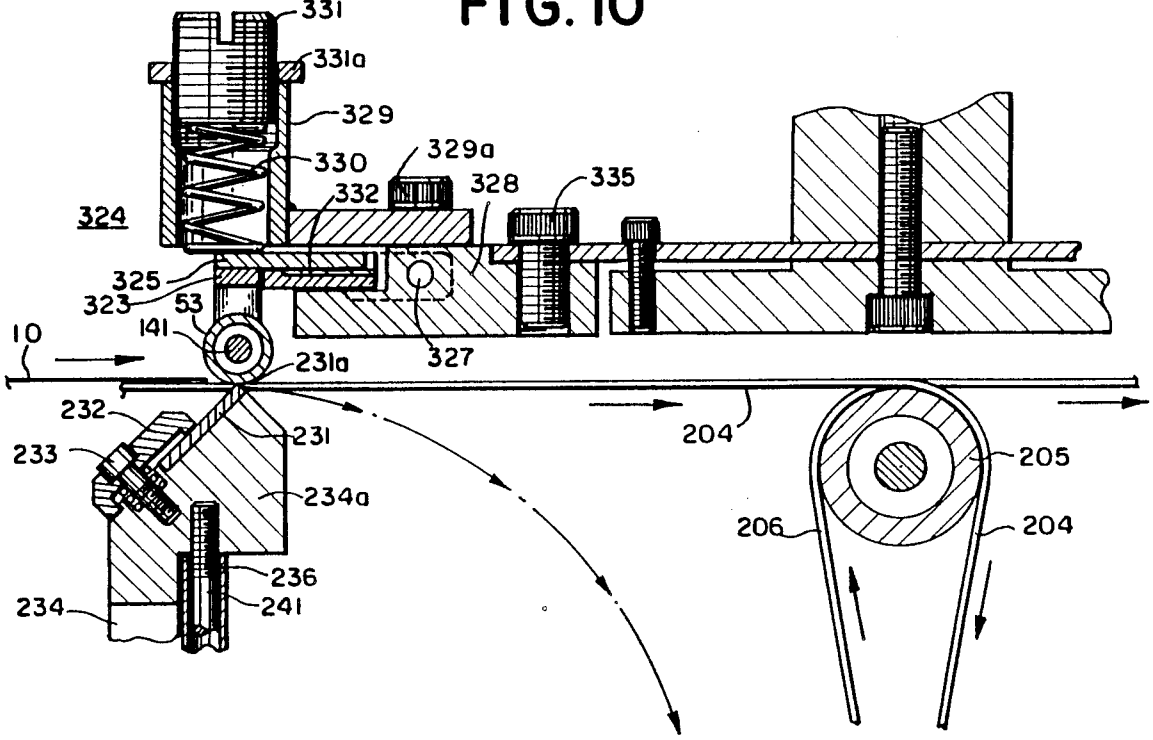
FIG. 10 is a fractional sectional view similar to FIG. 9 but of another embodiment of the invention in the rotary cutting apparatus.
Figure 11:
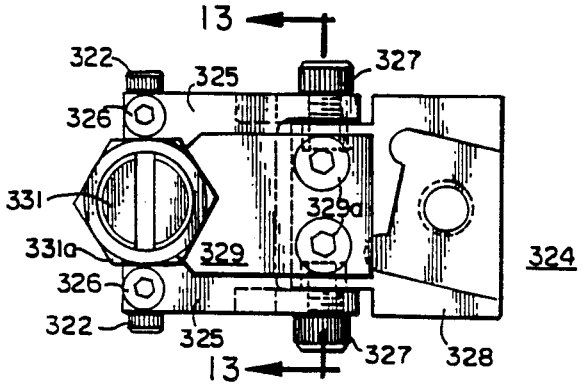
FIG. 11 is a top plan view of the embodiment illustrated in FIG. 10.
Figure 12:
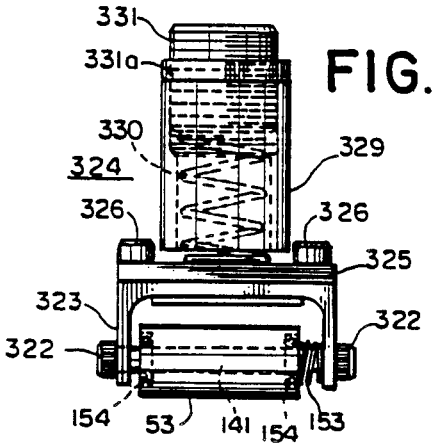
FIG. 12 is an elevational view from the left hand end of the embodiment illustrated in FIG. 11.
Figure 13:
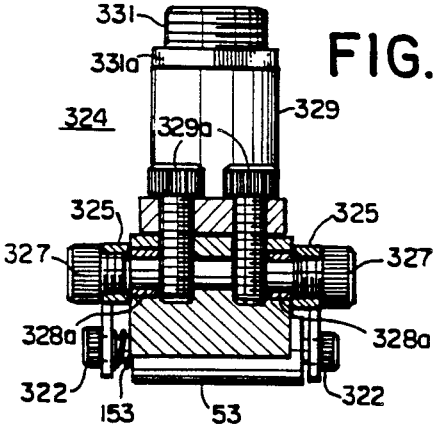
FIG. 13 is a sectional view taken along the lines 13-13 in FIG. 11.

While the invention has been described thus far in connection with cutting holes of substantial size in a thermoplastic film web at high speeds, the invention is also applicable to cutting a line of perforations across a plastic film web moving at high speeds. An embodiment of the invention for cutting perforations in thermoplastic film is illustrated in FIGS. 7–9. The web perforator 200 illustrated in FIGS. 7–9 utilizes the rotary cutting concept of the present invention and is applicable for making perforations for bags on a roll of consumer bags and other perforation applications. A thermoplastic film web 10 is fed into the web perforator 200 by draw rolls 201 and 202, and onto a series of horizontal belts 204 which also pass over the input drive roll 201 and are driven therefrom. The belts 204 provide a support for the film web 10 and while three have been illustrated in FIG. 8 it is to be understood that additional belts can be utilized. In one embodiment of the invention six belts were used in connection with six cutting apparatus. The belts 204 pass over and drive a roll 205, FIGS. 7 and 9, which in turn drives a corresponding plurality of horizontal belts 206. The belts 206 also provide a support for the web 1C after it leaves the belts 204. The belts 206 pass over a roll 207 at the right hand end of the web perforator 200 as shown in FIGS. 7 and 8. As may be seen in FIG. 8 the belts 204 and 206 are staggered with respect to each other. The web perforator 200 has been illustrated with two cutting stations I and II spaced horizontally with an adjustable on the fly phase angle between them so that the cuts or perforations will occur at substantially the same point, i.e. along approximately the same line on the film web 10. It is to be understood that the perforations made at the two stations I and II are off-set approximately 1/32" so as not to completely sever the web as it continues on through the bag line beyond station II. Each of the cutting stations I and II is provided with a plurality of spaced and staggered rotary cutting apparatus embodying the present invention, for example six at each station referred to generally by the reference numeral 24'. The two cutting or perforating stations I and II are spaced apart to provide the necessary space to support the plurality of the small cutting rollers 53 of the rotary cutting apparatus 24' and provide the additional advantage of being able to support the web 10 as it moves through the perforating stations an the conveyor belts. For convenience the corresponding parts in this embodiment have been provided with corresponding reference characters.

Each rotary cutting apparatus 24' is the same and comprises a tool steel roller 53 rotatably supported on a shaft 141, FIG. 9, of a bracket 140 fixed to a leaf spring 142 by suitable means such as screw 143. The spring 142 is also mounted by means of a bracket 144 and screw 146 to an end of a support arm 155. Cooperating with the roller 53 is a tungsten carbide die or cutter 231 in the form of a flat, substantially rectangular plate member held by means of a clamp 232 and screw 233 to a die holder block 234. The holder block 234 is in turn mounted to a elongated rectangular rotary shaft 237, the cylindrical ends 238 of which are supported in bearings for rotation about the shaft axis 239. The spacing of the cutter die 231 from the rotary shaft 237 is adjustable and is accomplished by means of a lock screw 241, received in a bore in the head portion **234*a* of the holder block 234 remote from the rotary shaft 237 and a hollow, coaxial adjustment screw 236. As shown in FIG. 7, another cutter die is adapted to be supported on a second die holder block 234 extending radially in opposite direction from the opposing side of the rotary shaft 237 to permit two cuts to be made in the web 10 during each rotation of shaft 237. The shaft 237 is rotated clockwise in the direction of the arrow along a circular arc to move the die 231 in the same direction as the web 10. The cutter die 231 moves at the same speed as the film web 10 to minimize the chance of the cutting action breaking a fragile perforation. As may he seen in FIG. 9 the cutter roll 53 cooperates with the cutting edge 231*a* of the cutter die 231 in perforating the web 10. The axis of the cutter rolls 53, as shown in FIG. 8 preferably is skewed or inclined 15° relative to the cutting edge 231*a* such that the cutting of the web is always at a point contact rather than a line contact. When the die edge 231*a* engages the roller 53, FIG. 8, it tends to straighten the roller and force it to one side. Accordingly, a compression spring 153 is provided at one end of the roller 53 to push the roller back in position. It has been found that approximately 30 lbs of pressure is required between the roll 53 and the cutting edge 231*a*** to cut 6 mils of film.

As previously described and as illustrated in FIGS. 7 and 8, the web perforator 200 is provided with a plurality of spaced and staggered cutting apparatus 24' at each of the two cutting stations I and II. The cutter dies 231 of the rotary cutting apparatus 24' at the first cutting station I are driven by the shaft 237. The cutter dies 231 of the rotary cutting apparatus 241 at the second cutting station II are illustrated at the right hand side of FIGS. 7 and 8. These cutter dies 231 at the second cutting station are driven from the rotary shaft 237'. The two shafts 237 and 237' are synchronized by means of a common gear belt 242 which passes around the pulleys 243 and 244 on the respective shafts 237 and 237' and the intermediate or idler pulleys 246–251.

Since the rotary cutting devices 24' at the first cutting station I are spaced from each other transversely of the web this will provide a series of cuts or perforations in the web which are likewise spaced transversely from each other but on the same line. A similar series of staggered spaced cuts or perforations will be made by the rotary cutting devices 24' at station II when the web 10 passes the second cutting station II. By adjusting the phase angle between the cutter dies 231 on shaft 237 at the first cutting station I and the cutter dies 231 on the shaft 237' at the second cutting station II, it can be assured that the staggered cuts or perforations in the web will occur at the required point on the web 10 and with the desired off-set as previously described. In one embodiment the web perforator was designed for a width capability of 12" and with suitable adjustments to handle a repeat distance between perforations of 18" to 30". This repeat flexibility is accomplished by providing the rotating cutting edges **231*a* of the cutter dies 231** with an adjustable radius as previously described.

Referring to FIGS. 10–13 there is illustrated a modification of the roller cutting apparatus 24' which is identified by the general reference character 324. It will be recognized that the roller cutting apparatus 324 would be incorporated in the apparatus of FIGS. 7–9 in the same manner as the roller cutting apparatus 24'. Thus all of such details are not repeated here and corresponding parts are identified with corresponding reference characters. Each rotary cutting apparatus 324 is the same and comprises a tool steel roller 53 rotatably supported on a shaft 141, FIGS. 10 and 12, by means of a pair of bearings 154. The ends of the shaft 141 are secured to a bracket 323 by means of a pair of screws 322. The bracket 323 depends from a rocker arm 325 and is secured thereto by a pair of screws 326. The rocker arm 325 is pivotably carried by a pair of hinge pins 327 extending into bushings **328*a* in a support member 328 for the roller 53. A housing 329 for a helical loading spring 330 is secured to the support member 328 adjacent the rocker arm 325 by a pair of screws 329*a*. The housing 329 has a tubular opening therethrough having an axis extending transversely to the axis of the shaft 141** supporting the roller 53. The helical loading spring 330 is disposed within the tubular opening of the housing 329 and has the lower end thereof engaging the top of the rocker arm 325. A spring adjusting screw 331 with a lock nut 331*a* is threadedly carried in the outer end of the tubular opening in the housing 329 for engaging the opposite end of the helical spring 33 to adjust the load pressure of the spring 330 applied to the roller 53. A stop member 332 is carried by the support member 328 on the opposite side of the rocker arm 325 to limit the movement of the roller 53 in the direction of the cutting surface or edge 231*a* of the cutter die 231 in perforating the web 10. A compression spring 153 is positioned on the shaft 141 at one end of the roller 53 to push the roller back in position as previously described in connection with the embodiment illustrated in FIGS. 7–9. As may be seen in FIG. 10 the cutter roller assembly is secured to a stationary portion of the apparatus by means of a screw 335 which extends into the support 328.

From the foregoing it will be seen that the screw 331 provides a fine adjustment for the preload of the spring 330 on the cutter roller 53. Once the adjustment has been made the screw 331 is locked in place by the lock nut 331*a* to maintain the load pressure of the spring applied to the roller. With the embodiment illustrated in FIGS. 10–13 the roller 53 may be easily replaced. This will be seen from the subassembly consisting of the bracket 323, shaft 141, bearings 154, spring 153 and the cutter roller 53 which subassembly is held in place by the two screws 326.

While there have been described preferred embodiments of the invention, it will be understood that further modifications may be made without departing from the spirit and scope of the invention as set forth in the appended claims.

What is claimed is:

1. Apparatus for cutting a moving plastic film web at predetermined location:

a die having a cutting surface;

means supporting said die for rotating said cutting surface along a circular arc; and roller means positioned at a stationary location along the circular arc for cyclicly contacting and rolling across the cutting surface for cutting the plastic film web passing between said roller means and said cutting surface at the predetermined locations in the web, said roller means comprising a roller mounted on a support member by an assembly including a bracket mounting a shaft supporting said roller, said bracket being attached to one end of a rocker arm in depending relation and the other end of the rocker arm being pivotably carried by said support member, a housing for a loading spring carried by said support member adjacent said one end of said rocker arm and above said roller, said housing having a tubular opening therethrough having an axis extending transversely to the axis of said shaft supporting said roller, a helical loading spring disposed within said tubular opening of said housing and having one end engaging said rocker arm at said one end thereof to apply a load pressure to said roller, spring adjusting screw means threadedly carried in one end of the tubular opening in said housing for engaging the opposite end of the helical spring to adjust the load pressure of said spring applied to said roller, and stop means carried by said support member to limit the movement of the roller in the direction of said cutting surface.

2. The apparatus of claim 1 wherein said cutting surface of said die is made of tungsten carbide and said roller comprises a roller of tool steel.

3. Apparatus according to claim 1 wherein the axis of said roller is skewed with respect to the cutting surface of said die.

4. Apparatus according to claim 3 including means for biasing said roller in the axial direction to maintain said roller in position when said roller cyclicly contacts and rolls across said cutting surface of said die.

5. Apparatus according to claim 1 including means for locking said spring adjusting screw means in adjusted position to maintain the load pressure of the spring applied to the roller.

6. In an apparatus for cutting a moving plastic film web at predetermined locations having a die with a cutting surface and means supporting the die for rotating the cutting surface along a circular arc, the improvement comprising:

roller means positioned at a stationary location along the circular arc for cyclicly contacting and rolling across the cutting surface for cutting the plastic film web passing between said roller means and the cutting surface at the predetermined locations in the web, said roller means comprising a roller mounted on a support member by an assembly including a bracket mounting a shaft supporting said roller, said bracket being attached to one end of a rocker arm in depending relation and the other end of the rocker arm being pivotally carried by said support member, a housing for a loading spring carried by said support member adjacent said one end of said rocker arm and above said roller, said housing having a tubular opening therethrough having an axis extending transversely to the axis of said shaft supporting said roller, a helical loading spring disposed within said tubular opening of said housing and having one end engaging said rocker arm at said one end thereof to apply a load pressure to said roller, spring adjusting screw means threadedly carried in one end of the tubular opening in said housing for engaging the opposite end of the helical spring to adjust the load pressure of said spring applied to said roller, and stop means carried by said support member to limit the movement of said roller in the direction of said cutting surface.

7. Apparatus according to claim 6 including means for locking said spring adjusting screw means in adjusted position to maintain the load pressure of the spring applied to the roller.

8. Apparatus according to claim 6 wherein said roller comprises a roller of tool steel.

9. Apparatus according to claim 6 including a compression spring mounted on said shaft for said roller for biasing said roller in the axial direction.

* * * * *